US007011303B2

(12) United States Patent
Takito et al.

(10) Patent No.: US 7,011,303 B2
(45) Date of Patent: Mar. 14, 2006

(54) SHEET FEEDER AND IMAGE FORMING APPARATUS HAVING THE SAME

(75) Inventors: Koji Takito, Nisshin (JP); Shingo Ito, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/396,386

(22) Filed: Mar. 26, 2003

(65) Prior Publication Data

US 2003/0184005 A1 Oct. 2, 2003

(30) Foreign Application Priority Data

Mar. 29, 2002 (JP) ..... 2002-094504

(51) Int. Cl.
*B65H 3/34* (2006.01)
*B65H 3/52* (2006.01)

(52) U.S. Cl. ..... 271/121; 271/167

(58) Field of Classification Search ..... 271/121, 271/167, 104, 137

See application file for complete search history.

(56) References Cited

U.S. PATENT DOCUMENTS 4,815,724 A * 3/1989 Sumida et al. ..... 271/121
5,419,544 A * 5/1995 Ono et al. ..... 271/164
6,086,062 A * 7/2000 Nakamura et al. ..... 271/121
6,158,733 A 12/2000 Muraki
6,168,150 B1 * 1/2001 Hori et al. ..... 271/121
6,536,757 B1 * 3/2003 Chang ..... 271/16

FOREIGN PATENT DOCUMENTS

| | | | |
|---|---|---|---|
| EP | 0 281 073 | * | 2/1988 |
| JP | U-63-126335 | | 8/1988 |
| JP | A-64-53939 | | 3/1989 |
| JP | A 10-310274 | | 11/1998 |
| JP | 11-11719 | * | 1/1999 |
| JP | A 2000-168980 | | 6/2000 |
| JP | A-2001-106346 | | 4/2001 |
| JP | A 2001-106367 | | 4/2001 |
| JP | A 2001-253580 | | 9/2001 |
| JP | A 2001-278507 | | 10/2001 |

* cited by examiner

*Primary Examiner*—Donald P. Walsh
*Assistant Examiner*—Kenneth W Bower
(74) *Attorney, Agent, or Firm*—Oliff & Berridge, PLC

(57) ABSTRACT

An auxiliary support plate is connected, by a leaf spring, to a middle portion of a lower end of a sheet holder, in a sheet width direction, so that a lower end part of the auxiliary support plate rotates and retracts below an upper surface of the sheet holder. A sheet feed roller, facing an upper surface of the auxiliary support plate, is rotatably supported by an arm, which can rotate about a drive shaft disposed upstream in a sheet advance direction.

18 Claims, 10 Drawing Sheets

SHEET FEEDER AND IMAGE FORMING APPARATUS HAVING THE SAME

BACKGROUND OF THE INVENTION

1. Field of Invention

The invention relates to a sheet feeder that feeds cut sheets and an image forming apparatus including the sheet feeder, and more particularly, to a device that separates and feeds sheets, one by one, by abutting leading edges of the sheets in a sheet feed direction against an inclined separating surface formed by separating plates.

2. Description of Related Art

Conventional image forming apparatuses, such as laser-beam printers, color ink-jet printers, facsimile machines and copying machines, include a sheet feeder that feeds cut sheets, one by one, to an image forming unit provided therein. As disclosed in U.S. Pat. No. 6,158,733 and Japanese Laid-Open Patent Publication No. 2001-278507, the sheet feeder includes an inclined sheet holder, which holds a stack of sheets thereon, a separating plate, which is disposed below the sheet holder and has an inclined separating surface, and a sheet feed roller that is attached to an end of a rotatable arm having a predetermined length so as to face the sheet holder. The inclined separating surface extends such that the inclined separating surface and an upper surface of the sheet holder form an obtuse angle therebetween. Thus, the sheets stacked on the sheet holder are held by the inclined separating surface of the separating plate with the leading edges of the sheets contacting the inclined separating surface.

As the sheet feed roller rotates while pressing a topmost sheet in the stack on the sheet holder, the leading edge of the topmost sheet, which is being downwardly fed, abuts against the inclined separating surface. At that time, with a reaction force from the inclined separating surface, the topmost sheet is conveyed in a state where the lower part of the sheet is bent in a direction orthogonal to a direction that the rest of the sheets extend (the topmost sheet is convexedly warped such that the surface of the topmost sheet comes away from the stack of the sheets). Before long, the trailing edge of the sheet comes away from the inclined separating surface and thus only the topmost sheet is separated from the stack of the sheets. After that, the separated sheet is fed to the image forming unit by a conveying roller provided in a sheet feed path, to form an image thereon. Then, the sheet having the image is ejected from the image forming apparatus.

U.S. Pat. No. 6,158,733 discloses a sheet feeder that includes a feed tray, a support, which has an inclined holding surface provided below the feed tray, and a hopper plate. Between a lower end of the feed tray and the support, the hopper plate having a center of rotation on the side of the lower end of the feed tray, is inclinatorily provided. A compression spring is provided on the reverse side of the feed tray. A semi-cylindrical feed roller is fixedly provided facing an upper surface of the hopper plate. When a large number of sheets are stacked on the feed tray, the hopper plate retracts against the urging force from the compression spring, and thus, all of the stacked sheets are held by the support.

In addition, U.S. Pat. No. 6,158,733 discloses auxiliary holders that selectively protrude and retract with respect to an upper surface of the support (the inclined holding surface) to receive leading edges of the sheets. The upper surface of the support has a high frictional resistance. When rigid or strong sheets are fed from the feed tray, the auxiliary holders, having a low frictional resistance, protrude so that the sheets can be easily separated, one by one, from the stack of sheets. When soft or weak sheets are fed from the feed tray, the auxiliary holders retracts so that the leading edges of the sheets are held by the support having a high frictional resistance. Thus, the sheets are separated, one by one, from the stack of sheets.

However, in sheet feeders like the sheet feeder disclosed in U.S. Pat. No. 6,158,733, a distance between the sheet feed roller and the upper surface of the feed tray is maintained constant. Because of this structure, a maximum number of sheets that can be loaded on the feed tray is limited. In order to solve this problem, in recent sheet feeders, a sheet feed roller is rotatably supported by an arm, which can rotate about a center of rotation provided at a position upstream of the sheet feed roller in a sheet advance direction.

In the recent sheet feeders, a separating portion having a high coefficient of friction is provided to a portion of an inclined separating surface so as to surely separate sheets one by one even when the sheets are soft or weak. In this case, however, even when an angle (exterior angle) $\theta$ of less than 90 degrees formed between an extension of the surface of the feed tray and the inclined holding surface is constant, the leading edges of the sheets abut against the separating portion and thus lower parts of the sheets bend. Therefore, an angle between the sheets and the inclined separating surface becomes smaller than the angle $\theta$, and the sheets are separated under this condition.

When rigid or strong sheets are fed from such the feed tray by the feed roller, the angle between the leading edges of the sheets and the inclined separating surface is not changed from the angle $\theta$ because lower parts of the sheets are hard to bend. Accordingly, the sheets are caught on the separating portion, and the sheet separation cannot be accomplished.

SUMMARY OF THE INVENTION

The invention thus provides a sheet feeder that can surely separate and feed sheets one by one from a stack of sheets regardless of the rigidity of the stacked sheets, and an image forming apparatus including the above-described sheet feeder.

A sheet feeder of the invention separates and feeds sheets. The sheet feeder includes a sheet holder that holds a plurality of sheets, a sheet feed roller that holds the sheets in cooperation with the sheet holder and feeds a topmost sheet from the sheets stacked in the sheet holder, and an inclined separating surface that holds leading edges of the sheets in a sheet feed direction. The sheet holder includes a fixed support plate, which is fixedly provided and has a fixed surface, and a movable support plate, which has a movable surface and is disposed at a portion opposite to and near the sheet feed roller so as to be capable of retracting with respect to the fixed surface when the sheet feed roller feeds the sheets.

With this structure, when weak or soft sheets are fed from the sheet holder, a leading edge of a topmost sheet of the stack slides over the inclined separating surface with a small rotation force of the sheet feed roller. Thus, the topmost sheet can be applied with the sheet separating action. Accordingly, the movable support plate does not need to retract below the upper surface of the sheet holder. When rigid or strong sheets are fed from the sheet holder, the leading edges of the sheets held by the sheet holder are surely received by the inclined separating surface. Therefore, the rotation force of the sheet feed roller becomes strong, so that the force to press the movable support plate from the sheet feed roller becomes large. Thus, the movable support plate retracts below the sheet holder against the urging force from the urging member. At that time, the topmost sheet warps along a space formed between the topmost sheet and the rest of sheets, which backwardly deform, at its lower part between the leading edge of the topmost sheet and a portion near the connection of the movable support plate and the fixed support plate, so that the inclined angle of the leading edge of the topmost sheet to the inclined separating surface becomes more acute. Because of this, it is easy to slide the leading edge of the topmost sheet over the inclined separating surface, and the sheet can be separated one by one from the stack of sheets. The degree of the inclination of the movable support plate can be changed in accordance with the rigidity of the sheets and degree of the rotation force of the sheet feed roller. With this structure, the sheet separating action can be further improved, and thus, a paper jam, such as a multi-feed problem, can be prevented.

BRIEF DESCRIPTION OF THE DRAWINGS

Various embodiments of the invention will be described in detail with reference to the following figures wherein.

DETAILED DESCRIPTION OF PREFERRED EMBODIMENTS

Embodiments of the invention will be described with reference to the accompanying drawings. A first embodiment of the invention will be described below.

Figure 1:
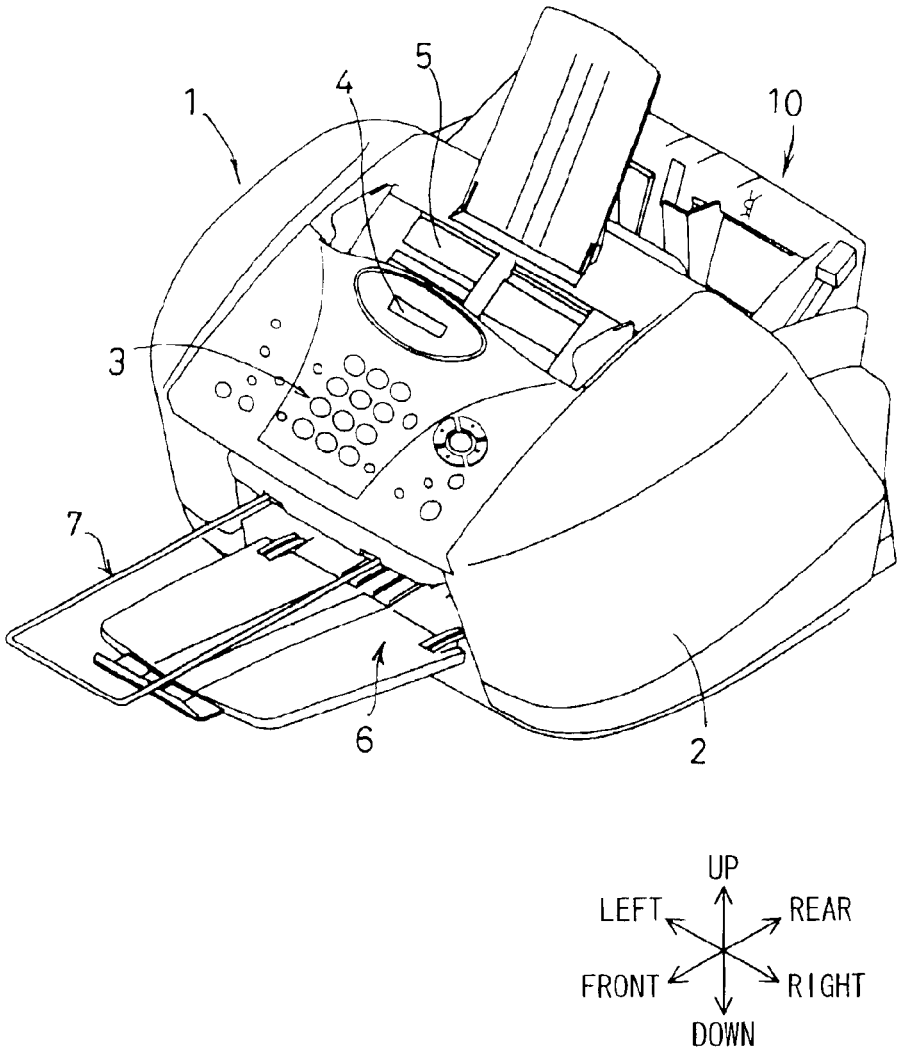
FIG. 1 is a perspective view of an image forming apparatus according to a first embodiment of the invention.

A multifunctional image forming apparatus 1 of FIG. 1 has a facsimile function, a printing function, a copying function, and a scanning function. As shown in FIG. 1, the image forming apparatus 1 includes a substantially box-shaped body 2. The body 2 has an operating panel 3 on its upper surface. The operating panel 3 is provided with various buttons and/or keys, such as a start button, numeric (0 to 9) buttons, and function keys. By pressing the buttons and keys, various operations are performed. A liquid crystal display (LCD) 4 is provided at an upper portion of the operating panel 3 to display setting conditions of the image forming apparatus 1 and various messages as needed. A side, on which the operating panel 3 is provided, is defined as a front of the image forming apparatus 1, and an opposite side is defined as a rear of the image forming apparatus. The right and left sides of the image forming apparatus 1 are defined as right and left, respectively, when viewed from the front of the image forming apparatus.

A document holding portion 5 is provided at the rear of the LCD 4. The document holding portion 5 holds original documents, which are to be copied and transmitted to another facsimile machine in the facsimile mode or which are to be copied in the copy mode. The original documents placed on the document holding portion 5 are conveyed to a scanning unit (not shown) provided in the body 2 and surfaces of the original documents are scanned by the scanning unit. Then, the scanned documents are ejected onto a document discharge portion 7 provided at the front of the body 2 (under the operating panel 3).

A sheet feeder 10, on which a stack of recording sheets P are loaded, is provided at the rear of the document holding portion 5. The sheets P placed on the sheet feeder 10 are conveyed, one by one, to a color ink-jet type image forming unit (not shown) provided in the body 2. At the image forming unit, predetermined images are printed onto the sheets P, and then, the sheets P are ejected onto a sheet discharge portion 6. The image forming unit is not limited to the ink-jet type, but can be other types, for example, a laser printing type using toner or a thermal transfer type using an ink ribbon.

Figure 2:
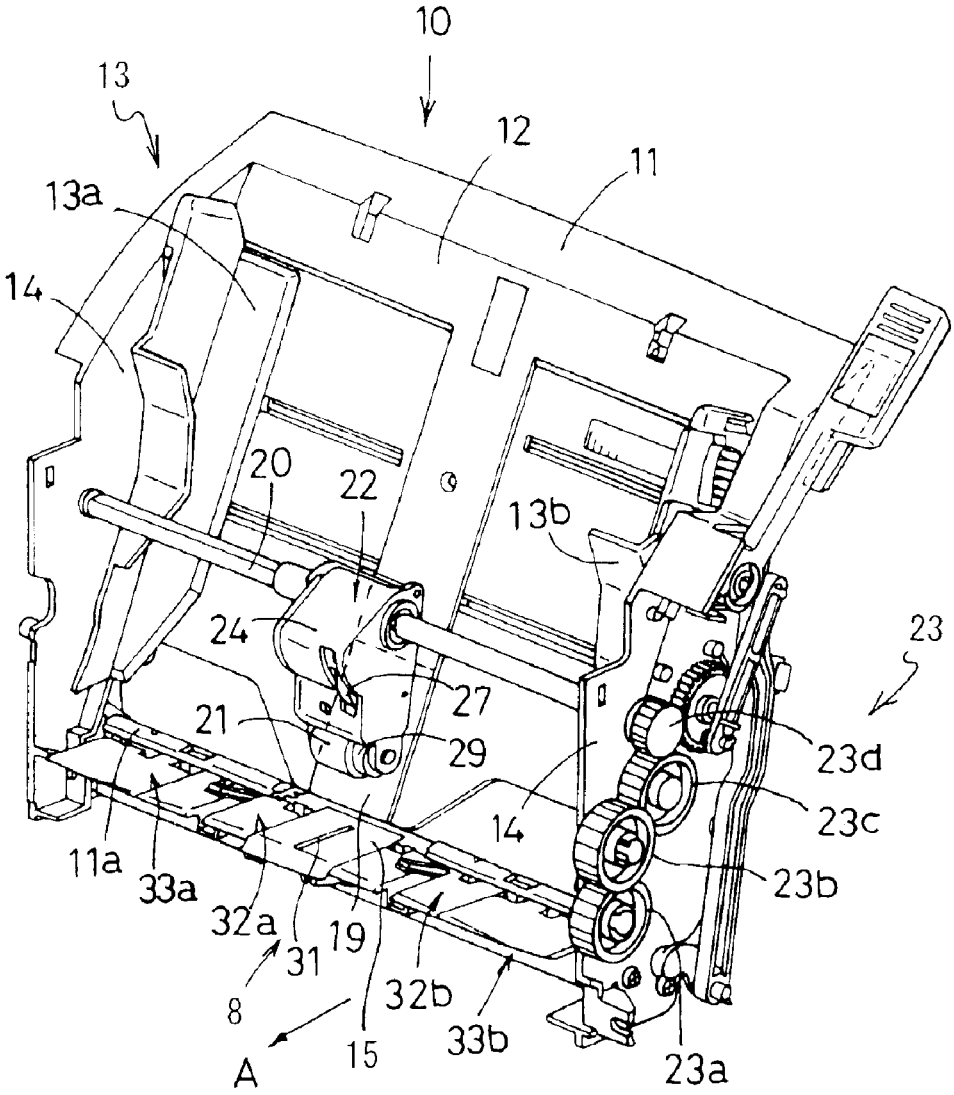
FIG. 2 is a perspective view of a sheet feeder according to the first embodiment of the invention.
Figure 3:
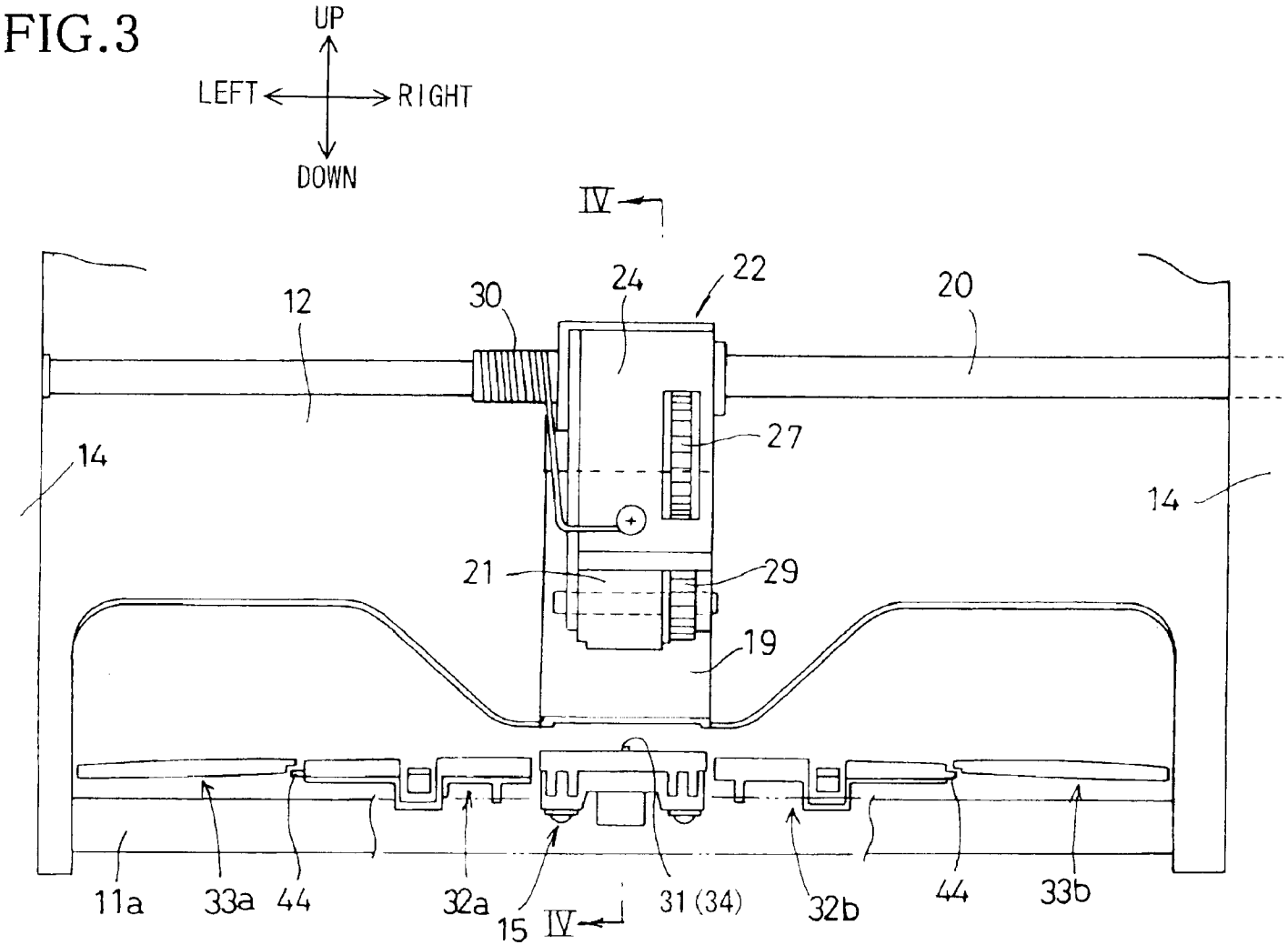
FIG. 3 is a front view showing essential parts of the sheet feeder.
Figure 4:
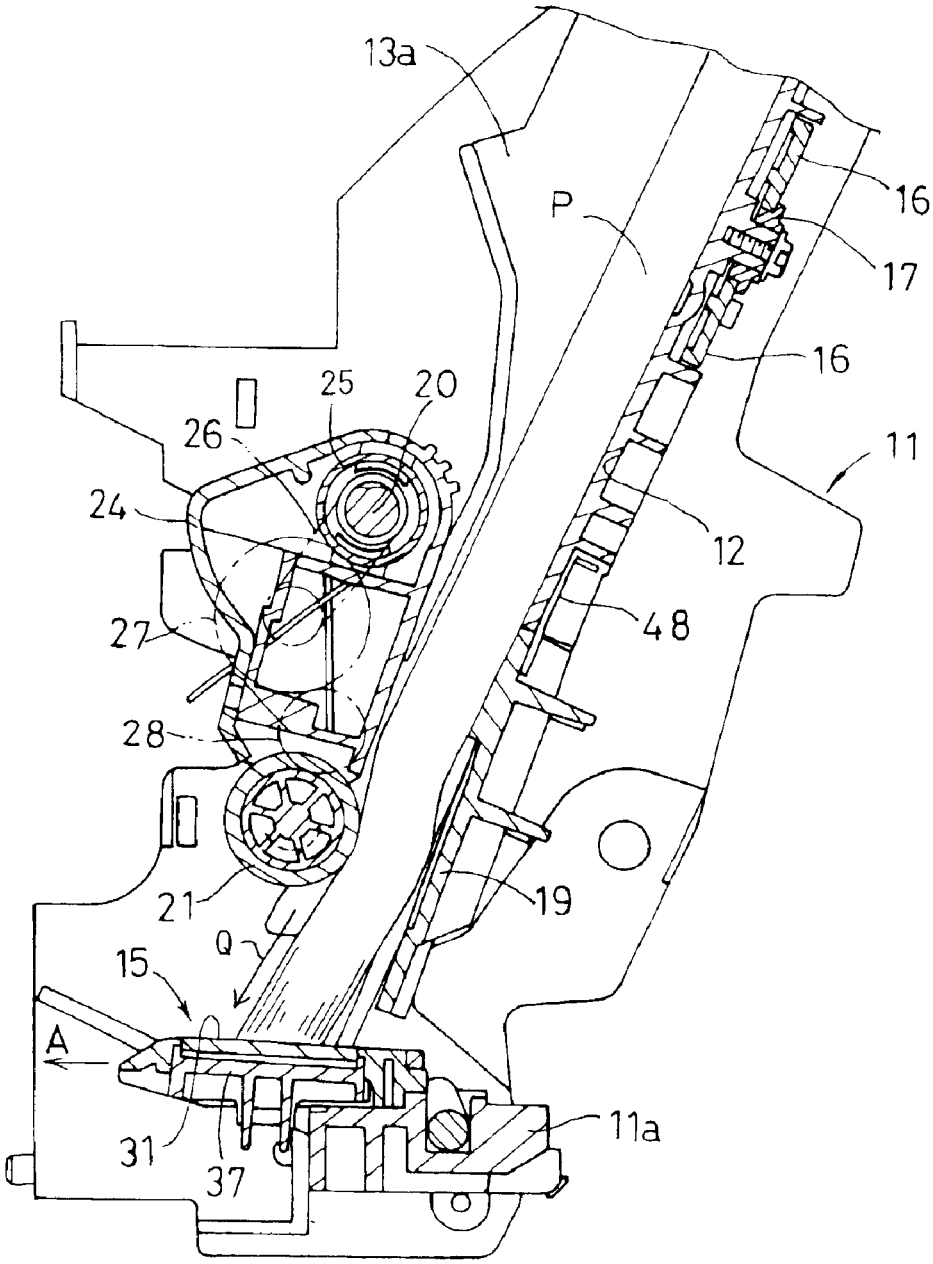
FIG. 4 is a sectional view taken along a line IV—IV of FIG. 3.

As shown in FIGS. 2 to 4, the sheet feeder 10 includes a frame 11. The frame 11 has a lower frame portion 11*a*. The frame 11 includes an inclined sheet holder 12, a pair of side walls 14 and a guide 13, i.e., a pair of guide members 13*a*, 13*b*. The sheet holder 12 is downwardly inclined in a direction toward the front of the image forming apparatus 1. The side walls 14 integrally stand from right and left edges of the sheet holder 12. The guide members 13*a*, 13*b* are provided to the sheet holder 12 and inside with respect to the side walls 14. The guide members 13*a*, 13*b* are slidable in right and left directions with respect to the sheet holder 12. The sheet holder 12 and the side walls 14 are made of synthetic resin and integral to form a monolithic structure. The sheet holder 12 can hold a stack of sheets P thereon.

Figure 11A:
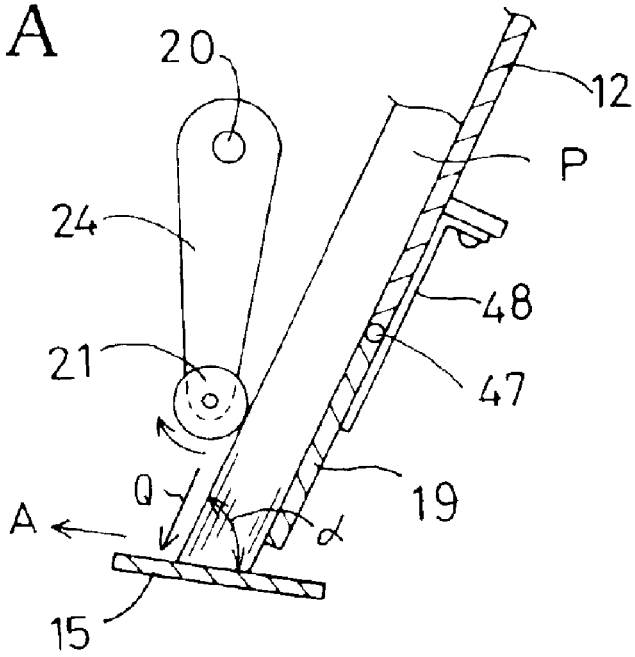
FIG. 11A is an explanatory diagram showing a sheet separating action when soft or weak sheets are fed.
Figure 11B:
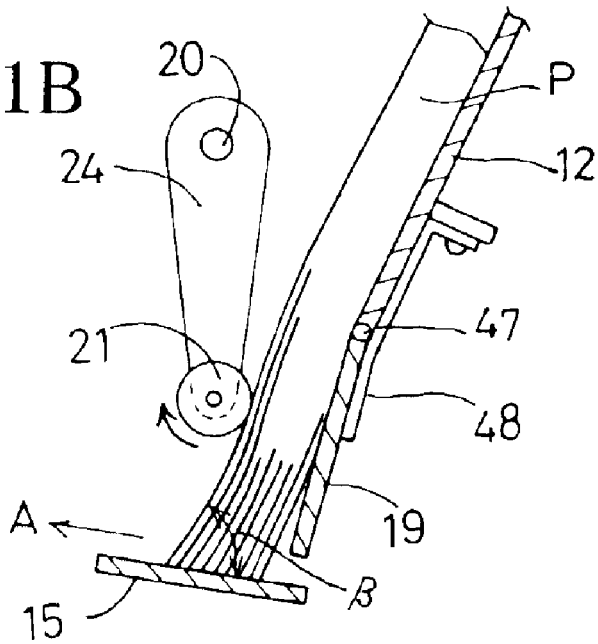
FIG. 11B is an explanatory diagram showing a sheet separating action when rigid or strong sheets are fed.

As shown in FIG. 4, an auxiliary support plate 19 is provided between a lower end of the sheet holder 12 and the lower frame portion 11*a* of the frame 11 such that an upper surface of the auxiliary support plate 19 is substantially in the same plane as the surface of the sheet holder 12. The auxiliary support plate 19 has a width substantially the same as the width of the sheet feed roller 21 (FIG. 3). As shown in FIGS. 11A and 11B, an upper end of the auxiliary support plate 19 is rotatably connected with the lower end of the sheet holder 12 via a hinge 47. Alternatively, as shown in FIG. 4, a free end of a leaf spring 48, which is provided on the underside of the sheet holder 12, is connected to the auxiliary support plate 19 by a screw or adhesive so that the upper surface of the auxiliary support plate 19 is substantially in the same plane as the surface of the sheet holder 12.

With this structure, when a rotation force of the sheet feed roller 21 becomes stronger than or equal to a predetermined force, the sheet feed roller 21 presses the stack of sheets P toward the sheet holder 12 to retract a lower portion of the auxiliary support plate 19 below the plane in which the surface of the sheet holder 12 extends.

The lower frame portion 11*a* of the frame 11 is provided with a plurality of separating plates 15, 32*a*, 32*b*, 33*a*, 33*b* to receive leading edges of the sheets P and to guide and send the sheets P, one by one, to the image forming unit. Upper surfaces of the separating plates 15, 32*a*, 32*b*, 33*a*, 33*b* form an inclined separating surface 8, which is an upwardly convex surface. The separating plates 15, 32*a*, 32*b*, 33*a*, 33*b* protrude from the lower frame portion 11*a* in a sheet advance direction indicated by an arrow A in FIGS. 2 and 4 to hold the leading edges of the sheets P stacked on the sheet holder 12 (FIGS. 2, 3 and 4). Explanations of the inclined separating surface 8 and the separating plates 15, 32*a*, 32*b*, 33*a*, 33*b* will be provided later.

The guide members 13*a*, 13*b* are coupled to racks 16, which are disposed on the back of the sheet holder 12 and extend in a horizontal direction. A pinion 17 is also provided on the back of the sheet holder 12 so as to engage the racks 16. In synchronization with the racks 16 and the pinion 17, the pair of the guide members 13*a*, 13*b* slide in a width direction of the sheet holder 12 (in the right and left directions) (FIGS. 2 and 3). Thus, the guide members 13*a*, 13*b* can get closer to and get away from each other to guide side edges of the sheets P in accordance with the width of the sheets P stacked between the guide members 13*a* and 13*b*. Consequently, the sheets P can be placed in the middle of the sheet holder 12 in the width direction of the sheets P.

A drive shaft 20 is rotatably supported between the side walls 14, at an appropriate distance upward from the upper surface of the separating plate 15. A sheet feed roller unit 22 is provided substantially at the middle of the drive shaft 20, that is, at the middle of the sheet P in the width direction (in the right and left directions). The sheet feed roller unit 22 includes a case 24 having a sheet feed roller 21. The drive shaft 20 is inserted into the case 24 of the sheet feed roller unit 22 so that only the case 24 can freely rotate. A gear train 23, including gears 23*a*, 23*b*, 23*c*, 23*d*, is provided to an outer surface of one of the side walls 14 in order to transmit power to the sheet feed roller 21 from a drive motor (not shown) provided in the body 2 (FIG. 2).

As shown in FIG. 4, the case 24 of the sheet feed roller unit 22 contains a drive gear 25 that integrally rotates with the drive shaft 20, a planet gear 27 that engages the drive gear 25, and an intermediate gear 28. A gear 29 is provided so as to engage the intermediate gear 28 and integrally rotate with the sheet feed roller 21. A part of the gear 29 is covered with a lower portion of the case 24. An arm 26 is rotatably fitted to the drive shaft 20. The planet gear 27 is rotatably supported by the arm 26. A torsion spring 30 (FIG. 3) is fitted into the drive shaft 20. The case 24 is urged by the torsion spring 30 so that the sheet feed roller 21 is pressed against a surface of a topmost sheet P in the stack.

As the gear 23*d*, which is fixed to an end of the drive shaft 20, rotates in a normal direction (in a counterclockwise direction in FIG. 2) at a sheet feeding operation, the drive gear 25 also rotates in the normal direction. At that time, a force for rotating in a reverse direction (in a clockwise direction in FIG. 2) is applied to the planet gear 27 engaging the drive gear 25, so that the arm 26 swings in the normal direction and thus the planet gear 27 engages the intermediate gear 28. Therefore, the intermediate gear 28 rotates in the normal (counterclockwise) direction and the gear 29 and the sheet feed roller 21 rotate in the reverse (clockwise) direction. Thus, the topmost sheet P, which is in contact with the sheet feed roller 21, is conveyed downward in FIG. 4. Also, when the drive shaft 20 rotates in a normal direction, the planet gear 27 also presses the case 24 through the intermediate gear 28 with a sheet feed force (rotation force) against the surface of the topmost sheet P.

When the gear 23*d* rotates in the reverse (clockwise) direction, the planet gear 27 is applied with a force for rotating in the normal direction from the drive gear 25 rotating in the reverse direction. Therefore, the arm 26 swings in the reverse direction, so that the planet gear 27 disengages from the intermediate gear 28 and thus the power to the sheet feed roller 21 is disconnected. Consequently, the sheet feed roller 21 stops rotating, thereby stopping the sheet feeding operation (the sheets P are not fed).

Figure 5:
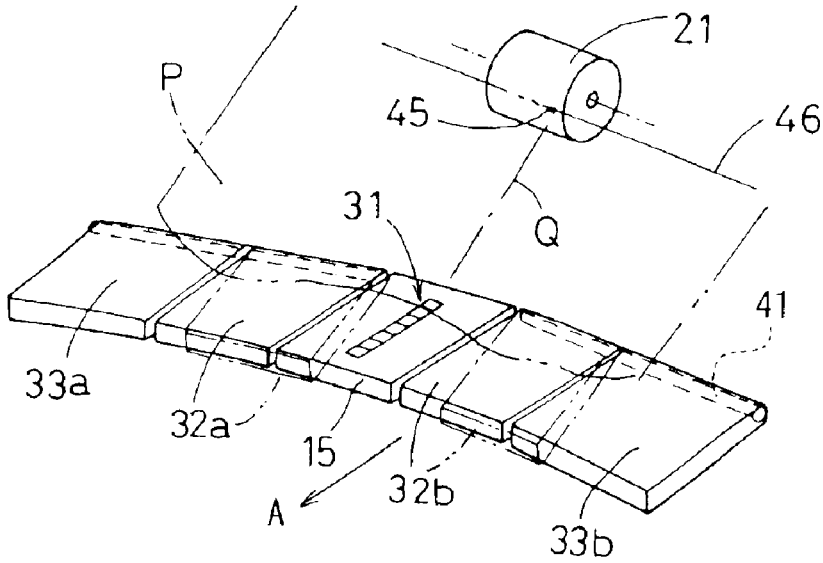
FIG. 5 is a perspective view of a split-type inclined separating surface, which includes a fixed separating plate and movable separating plates, according to the first embodiment.
Figure 7:
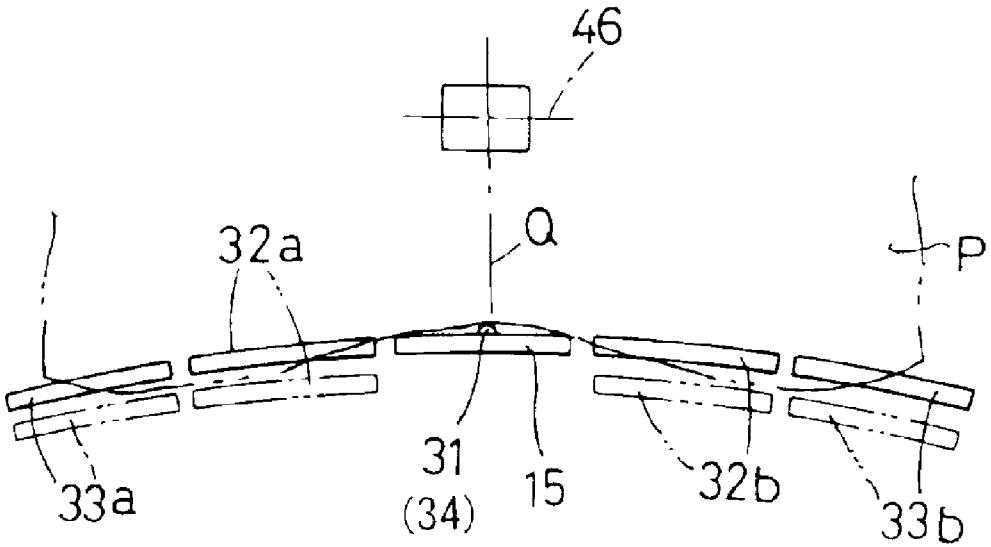
FIG. 7 is a front view of a split-type inclined separating surface according to a second embodiment.

Next, the structure of the inclined separating surface 8 of the first embodiment of the invention will be described in detail. The inclined separating surface 8 is provided with a sheet separating unit 31 having a high coefficient of friction. The sheet separating unit 31 contacts the leading (lower) edges of the middle areas of the sheets P in the sheet width direction to separate the sheets P, one by one, from the sheets P stacked on the sheet holder 12. The sheet separating unit 31, projecting from the inclined separating surface 8, is disposed on an extension of a line of sheet feeding action Q of the sheet feed roller 21 (FIGS. 5 and 7). The inclined separating surface 8 has a upwardly curved surface such that a portion near the sheet separating unit 31 is uplifted and the surface is gradually lowered near the ends of the inclined separating surface 8, in the sheet width direction.

FIGS. 2 to 6 show details of the shape and structure of the inclined separating surface 8 of the first embodiment. In the first embodiment, the inclined separating surface 8 is defined by upper surfaces of a fixed separating plate 15, first movable separating plates 32*a*, 32*b* and second movable separating plates 33*a*, 33*b*, which are made of synthetic resin. As shown in FIG. 3, the fixed separating plate 15 is disposed at a portion corresponding to the middle area of the sheet holder 12 in the width direction of the sheet holder 12 (at a portion on the extension of the line of sheet feeding action Q of the sheet feed roller 21). The first movable separating plates 32*a*, 32*b* are disposed on the left and right sides of the fixed separating plate 15, respectively. The second movable separating plate 33*a* is disposed on the left of the first movable separating plate 32*a*, and the second movable separating plate 33*b* is disposed on the right of the first separating plate 32*b*. Although the separating plates 15, 32*a*, 32*b*, 33*a*, 33*b* are separated from each other, the upper surfaces of the separating plates 15, 32*a*, 32*b*, 33*a*, 33*b* form the continuous inclined separating surface 8. That is, the middle of upper surface of the fixed separating plate 15 in the right and left direction is in the highest level and outer sides of the upper surfaces of the separating plates 33*a*, 33*b* are in the lowest level.

Figure 6:
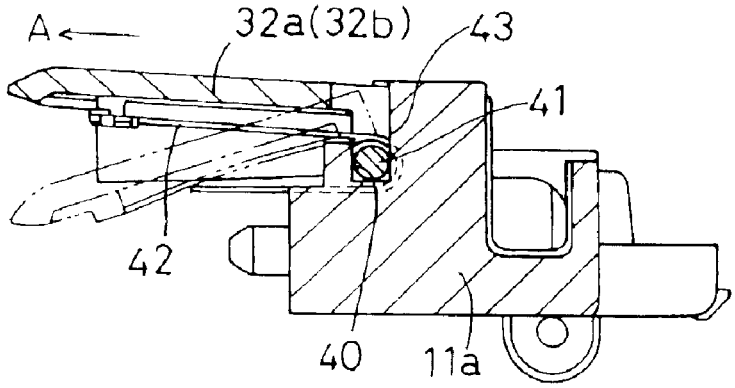
FIG. 6 is an enlarged sectional view of one of the movable separating plates.

As shown in FIG. 6, a rotation support shaft 41 integrally protrudes from a base to an end of each of the movable separating plates 32*a*, 32*b*, 33*a*, 33*b*. The lower frame portion 11*a* of the frame 11 has recessed portions 40, in which the rotation support shafts 41 of the movable separating plates 32*a*, 32*b*, 33*a*, 33*b* are rotatably fitted. Torsion springs 42 are fitted to the rotation support shafts 41 while both of the ends are caught at predetermined positions, in order to upwardly urge the separating plates 32*a*, 32*b*, 33*a*, 33*b*, independently. With this structure, appropriate movable separating plates 32*a*, 32*b*, 33*a*, 33*b* can be rotated by a pressing force from the stack of sheets P so as to make a clearance between the leading edges of the sheets P to be fed and the movable separating plates 32*a*, 32*b*, 33*a*, 33*b* according to the size of the sheets P. Therefore, a resistance (the urging force from the torsion springs 42) to the pressing force from the sheets P can become an appropriate strength, which is neither too strong nor too weak. The movable separating plates 32*a*, 32*b*, 33*a*, 33*b* are designed such that back surfaces 43 of the base end portions of the movable separating plates 32*a*, 32*b*, 33*a*, 33*b* contact inner walls of the recessed portions 40 to restrict excessive upward rotation of the movable separating plates 32*a*, 32*b*, 33*a*, 33*b*. With this restriction, the upper surfaces of the movable separating plates 32*a*, 32*b*, 33*a*, 33*b* are not lifted to the level higher than the upper surface of the fixed separating plate 15 and the second movable separating plates 33*a*, 33*b* are not lifted to the level higher than the upper surfaces of the first separating plates 32*a*, 32*b*. Alternatively, different ways can be adopted to restrict the excessive upward rotation of the movable separating plates 32*a*, 32*b*, 33*a*, 33*b*.

As the sheet feed roller 21 rotates, the leading edges of the sheets P to be supplied abut against the upper surfaces of the separating plates 15, 32*a*, 32*b*, 33*a*, 33*b* and thus a pressing force from the sheets P downwardly acts on the upper surfaces of the separating plates 15, 32*a*, 32*b*, 33*a*, 33*b*. By the pressing force from the sheets P, the movable separating plates 32*a*, 32*b*, 33*a*, 33*b* downwardly rotate (descend) against the urging forces from the torsion springs 42 (i.e. the free ends of the separating plates 32*a*, 32*b*, 33*a*, 33*b* point down by rotating downward about their base ends) to release the force from the sheets P.

As shown in FIG. 3, an engaging projection 44 laterally projects from the first movable separating plates 32*a*, 32*b* so as to engage the undersides of the second movable separating plates 33*a*, 33*b*, respectively, from below. With this structure, even when a downward load acts on the second movable separating plates 33*a*, 33*b* only, the second movable separating plates 33*a*, 33*b* rotate downward and thus engage the respective engaging projections 44 of the first movable separating plates 32*a*, 32*b* to press the engaging projections 44 downwardly. Thus, the first movable separating plates 32*a*, 32*b* also rotate downward with the second movable separating plates 33*a*, 33*b*.

Figure 8A:
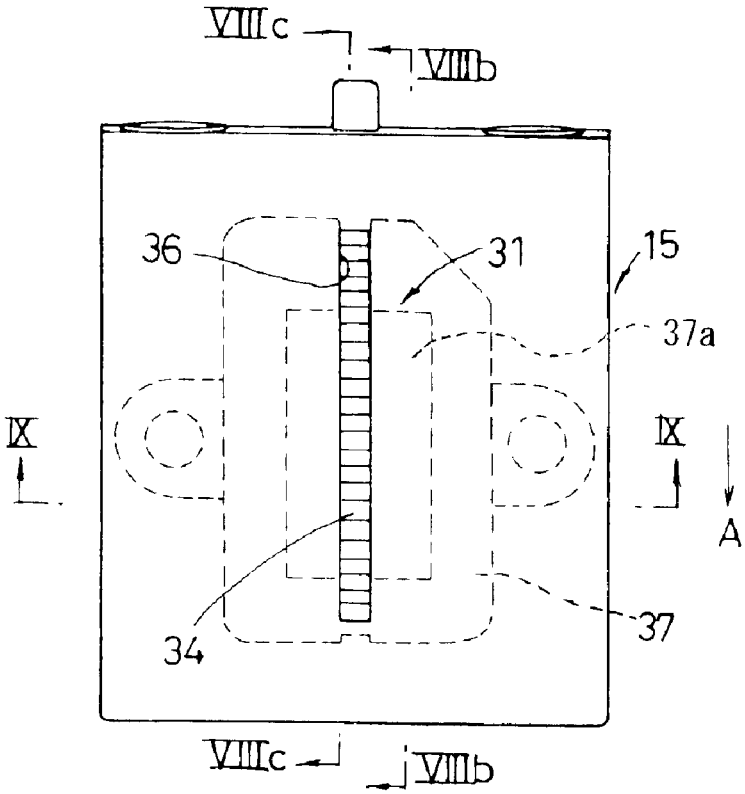
FIG. 8A is a plan view of the fixed separating plate including a sheet separating unit.

In the first embodiment, a distance between outer edges of the movable separating plates 33*a*, 33*b* is approximately 210 mm and a difference of elevation in the convexedly curved surface of the inclined separating surface 8 is approximately between 2 and 3 mm (a radius of curvature of the order of 1500 mm) (FIG. 3). It is designed such that the upper surfaces of the fixed separating plate 15 and the movable separating plates 32*a*, 32*b*, 33*a*, 33*b* are upwardly inclined approximately 3 degrees with respect to the horizontal plane so that their free ends (the direction indicated by the arrow A in FIGS. 2, 4 and 8A) are lifted with respect to the horizontal plane, when the movable separating plates 32*a*, 32*b*, 33*a*, 33*b* are free from a load (in a initial state). An inclined angle between the sheet holder 12 and each upper surface of the separating plates 15, 32*a*, 32*b*, 33*a*, 33*b* is an obtuse angle of approximately 112.5 degrees, when no load is applied to the movable separating plates 32*a*, 32*b*, 33*a*, 33*b*.

The sheet separating unit 31 includes a separating strip 34, extending in the front to rear direction, so that the separating strip 34 is disposed at the upper surface of the fixed separating plate 15, at the substantially middle in the right and left direction. FIGS. 8 to 10B show the structure of the fixed separating plate 15 and the sheet separating unit 31 having the separating strip 34 in detail. The fixed separating plate 15 has a slit 36, which penetrates the fixed separating plate 15 and extends along the sheet advance direction (the direction A in FIGS. 4 and 8A). A mounting block 37, made of synthetic resin, is detachably attached to the underside of fixed separating plate 15 by screws 38. The separating strip 34 is made of a material having a high coefficient of friction, such as polyester urethane resin. A bridge plate 39 includes a leaf spring made of phosphor bronze and has a plurality of cantilever supporting portions 39*a* and an outer frame portion 39*b*. The plurality of cantilever supporting portions 39*a* inwardly protrude from the outer frame portion 39*b*, like comb teeth, as shown in FIG. 10A. The separating strip 34 is resiliently supported by the cantilever supporting portions 39*a* of the bridge plate 39 such that the cantilever supporting portions 39*a* are inserted into the separating strip 34 (FIGS. 10A and 10B).

Figure 8B:
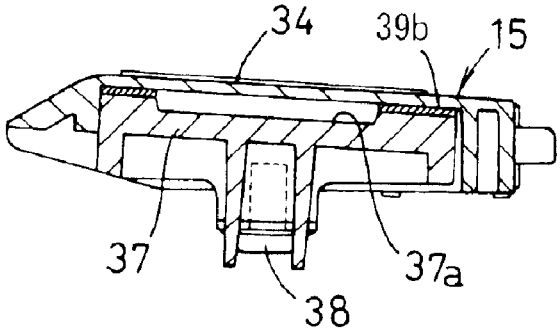
FIG. 8B is a sectional view taken along a line VIIIb—VIIIb of FIG. 8A.
Figure 8C:
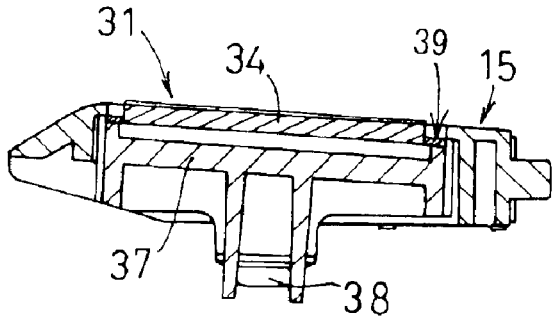
FIG. 8C is a sectional view taken along a line VIIIc—VIIIc of FIG. 8A.
Figure 9:
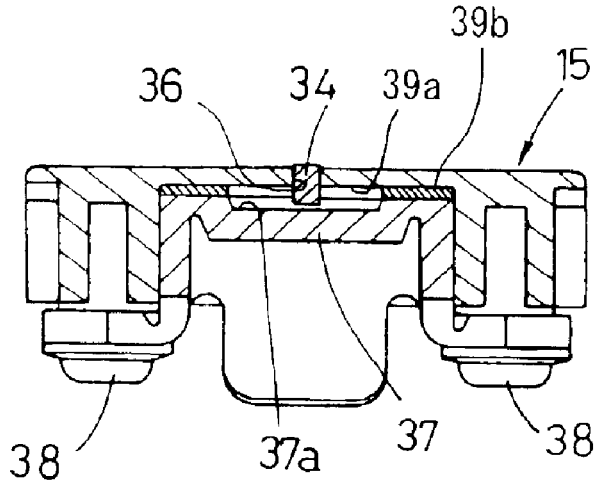
FIG. 9 is a sectional view taken along a line X—X of FIG. 8A.
Figure 10B:
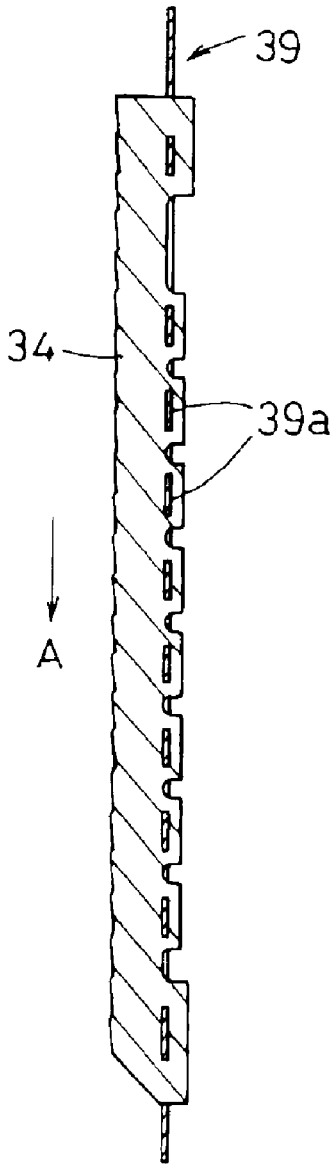
FIG. 10B is a sectional view taken along a line Xb—Xb of FIG. 10A.
Figure 10A:
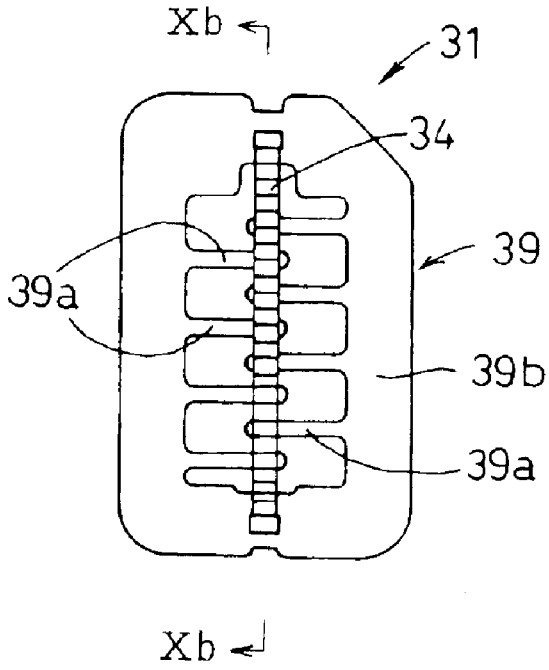
FIG. 10A is a plan view of the sheet separating unit.

Only the outer frame portion 39*b*, which has a substantially rectangular shape when viewed from above (FIG. 10A), is pinched between the mounting block 37 and the fixed separating plate 15, so that the separating strip 34 and the cantilever supporting portions 39*a* are held in midair in a recessed portion 37*a* of the mounting block 37 (FIGS. 8B, 8C and 9). Therefore, when a downward pressing force is applied to the separating strip 34 from above by the leading edges of the sheets P due to the sheet feeding operation by the sheet feed roller 21, the separating strip 34 is pressed downward and thus the plurality of the cantilever supporting portions 39*a* warp downwardly. Consequently, the upper surface of the separating strip 34 becomes the same level as the upper surface of the fixed separating plate 15.

If the coefficient of friction of the separating strip 34 is set so as to adapt to weak or soft sheets, rigid or strong sheets can be surely separated one by one from a stack of sheets by retracting the auxiliary support plate 19 below the surface of the sheet holder 12 to adjust the urging force from the leaf spring 48 to the sheets P.

As shown in FIG. 10B, the upper surface of the separating strip 34 is saw-toothed (uneven) so that a high frictional resistance can be applied to the sheets P when the leading edges of the sheets P contact and slide over the separating strip 34. The shape of the upper surface of the separating strip 34 further increases the coefficient of friction, in addition to the frictional coefficient of the material forming the separating strip 34.

Referring to FIGS. 4 and 5, the sheet separating action performed by the sheet feeder 10 in the above-described structure when the sheet feed roller 21 rotates to feed sheets P will be described below. First, a plurality of sheets P are loaded onto the sheet holder 12 of the sheet feeder 10 in advance. The guide members 13*a*, 13*b* are slid to guide and regulate side edges of the stacked sheets P. Therefore, the sheets P are disposed at the middle of the sheet holder 12 while the center line of the sheets P is disposed along the center line of the sheet holder 12 in the sheet width direction. In this state, the leading edges of the sheets P stacked on the sheet holder 12 are in contact with the upper surface of the fixed separating plate 15 and/or the separating strip 34, but not in contact with the first movable separating plates 32*a*, 32*b* nor the second movable separating plates 33*a*, 33*b*.

When a print command is executed in response to a signal transmitted from an external control device, such as a personal computer and a facsimile machine, the drive motor (not shown) drives to rotate the sheet feed roller 21. Therefore, the drive shaft 20 rotates in the reverse direction via the gear train 23 including the gears 23*a* to 23*d*, and then the sheet feed roller 21 rotates in the clockwise direction in FIGS. 5 and 11A.

In a case where the sheets P stacked on the sheet holder 12 are weak or soft, the sheets P are subjected to the sheet feeding action while the leading edges of the middle areas of the sheets P contact the sheet separating unit 31 (the separating strip 34) provided on the extension of the line of the sheet feeding action of the sheet feed roller 21 even when a sheet feeding force (rotation force) from the sheet feed roller 21 is weak. Thus, a force to press the auxiliary support plate 19 from the sheet feed roller 21 is not strong enough to retract the auxiliary support plate 19 below the level of the surface of the sheet holder 12 (i.e., the rotation force provided from the planet gear 27 is weak and a force that presses the intermediate gear 28 (case 24) is weak). Therefore, the auxiliary support plate 19 is maintained at the same level as the surface of the sheet holder 12 by the urging force from the leaf spring 48. That is, as shown in FIG. 11A, a contact angle (exterior angle) β between a lower part of the middle area of the topmost sheet P and the surface of the fixed separating plate 15 is maintained at the same angle (exterior angle) between the plane, in which the upper surface of the sheet holder 12 extends, and the plane, in which the upper surface of the fixed separating plate 15 extends (67.5 degrees). Under this condition, the sheets P are conveyed in the direction indicated by the arrow A.

When rigid or strong sheets P, such as cardboard, postcards, envelops, and overhead transparency films, are fed from the sheet holder 12, the leading edges of the middle areas of the sheets P are difficult to slide over the surface of the separating strip 34 because the leading edges of the sheets P are caught on the upper surface of the separating strip 34. Therefore, the rotation force from the sheet feed roller 21, which presses the lower part of the sheets P, becomes strong. Then, the auxiliary support plate 19 retracts below the sheet holder 12 in a direction toward the base end of the fixed separating plate 15 against the urging force from the leaf spring 48 (FIGS. 4 and 11B). Therefore, most of the lower part of the sheets P are inclined substantially along the inclination of the auxiliary support plate 19 (i.e., the rotation force provided from the planet gear 27 is strong and the force that presses the intermediate gear 28 (case 24) is strong). However, the leading edges of the sheets do not move from the positions because the leading edges of the sheets P are supported by the separating strip 34. Accordingly, the middle portions (a range between an upper end and a lower end of the auxiliary support plate 19) of the sheets P are pressed by the sheet feed roller 21 while the leading edges of the sheets P are held by the separation strip 34 and the fixed separating plate 15. Thus, as shown in FIG. 11B, the lower parts of the sheets P deform toward the auxiliary support plate 19 and a contact angle (exterior angle) β between the lower part of the middle area of the topmost sheet P and the surface of the fixed separating plate 15 becomes smaller than the contact angle α. That is, the contact angle β between the leading edge of the topmost sheet P and the separating strip 34 becomes small, so that the leading edge of the topmost sheet P easily slides over the surface of the separating strip 34. Accordingly, even when the sheets P are strong or rigid, the separating action can be surely applied to the leading edges of the sheets P. In this embodiment, it is designed such that the contact angle β is approximately 65 degrees.

That is, the auxiliary support plate 19 retracts so as to relieve the deformed portions of the sheets P whose leading edges are contacting the inclined separating surface 8, when the sheet feed roller 21 is driven to feed the sheets P. As described above, if the auxiliary support plate 19 is designed so as not to interfere with deformed portions of sheets P contacting the inclined separating surface 8 when the auxiliary support plate 19 retracts, the deformed portions of the sheets P having different rigidity can be relieved. When rigid or strong sheets are fed, only a topmost sheet P, which is pressed by the sheet feed roller 21, is fed in the direction A of FIGS. 4 and 11B, as described above.

The auxiliary support plate 19 is restricted so that the upper surface of the auxiliary support plate 19 does not protrude above the surface of the sheet holder 12 when the sheet feed roller 21 is not driven. Therefore, the sheet P are held by the sheet holder 12 and the auxiliary support plate 19 without their lower parts bending. With this structure, even when the sheet P are stacked on the sheet holder 12 and the auxiliary support plate 19 over an extended time period, the sheet P is not bent. Accordingly, when the printing operation is performed, the paper jam, such as a multi-feed problem, can be prevented.

In addition, the auxiliary support plate 19 is rotatably attached to the lower end of the sheet holder 12 and is supportingly urged by the leaf spring 48, as an urging member, provided on the underside of the sheet holder. Accordingly, the structure of the leaf spring and the structure to restrict the auxiliary support plate 19 so as not to protrude above the sheet holder 12 while the sheet feed roller 21 is not driven becomes simple.

The sheet P is conveyed while its side areas, which are other than the middle area of the sheet P and are not subjected to the sheet feeding action, are flat. When the above-described situation happens, a distance (in straight line) between a point on a contact line (nip line) 45 of the sheet feed roller 21 and the sheet P subjected to the sheet feeding action and a point of the leading edge of the middle area of the topmost sheet P becomes shorter than a distance (in straight line) between a point on an extension 46 of the contact line 45 and a point on the side area of the leading edge of the topmost sheet P.

Even when the above case happens, in the first embodiment, the position of the fixed separating plate 15, which corresponds to the middle areas of the sheets P in the sheet width direction, is not changed and the first separating plates 32*a*, 32*b* and/or the second separating plates 33*a*, 33*b* can surely receive the leading edges of the side areas of the weak or soft sheets P. On the other hand, for the strong or rigid sheets P, when the downward pressing force from the sheets P increases, the free ends of the movable separating plates 32*a*, 32*b*, 33*a*, 33*b* downwardly rotate against the urging forces from the torsion springs 42. By doing so, the upper surfaces of the separating plates 32*a*, 32*b*, 33*a*, 33*b* (the inclined separating surface 8) descend in a direction to get away from the leading edges of the sheets P to make a clearance between the leading edges of the sheets P and the separating plates 32*a*, 32*b*, 33*a*, 33*b*. Therefore, the leading edge of the topmost sheet P can be prevented from being interfered with the first movable separating plates 32*a*, 32*b* and/or the second movable separating plates 33*a*, 33*b* during the sheet feeding operation. Thus, the leading edge of the topmost sheet P is not pressed or supported by the first movable separating plates 32*a*, 32*b* and/or the second movable separating plates 33*a*, 33*b*. Consequently, the sheet separating action by the sheet separating unit 31 can be surely applied to the leading edges of the middle areas of the sheets P. In addition, the occurrence of a paper jam due to, such as the multi-feed problem (feeding two or more sheets at a time), can be restricted.

When the width (size) of the sheets P stacked on the sheet holder 12 is small (when the width of the sheets P is shorter than a distance between the outer edges of the first movable separating plates 32*a*, 32*b* adjacent to the fixed separating plate 15), the leading edges of the side areas of the sheets P contact and downwardly press the first movable separating plates 32*a*, 32*b*, which correspond to the side areas of the sheets P, and thus the first movable separating plates 32*a*, 32*b* rotate downward. Therefore, a clearance is created between the leading edges of the sheets P and the first movable separating plates 32*a*, 32*b*. Because the second movable separating plates 33*a*, 33*b* do not interfere with the sheets P, the second movable separating plates 33*a*, 33*b* stay as they are (do not rotate downward).

When the width (size) of the sheets P is large (when the width of the sheets P is longer than a distance between the inner edges of the second movable separating plates 33*a*, 33*b*), the leading edges of the side areas of the sheets P abut against the upper surfaces of the second movable separating plates 33*a*, 33*b* (the inclined separating surface 8) to rotate the second movable separating plates 33*a*, 33*b* downward. At that time, the first movable separating plates 33*a*, 33*b* can downwardly rotate with the second movable separating plates 32*a*, 32*b* via the engaging protrusions 44 even though the leading edges of the sheets P does not abut against the upper surfaces of the first movable separating plates 33*a*, 33*b* (the inclined separating surface 8). Accordingly, the interference of the leading edges of the sheets P and the separating plates 32*a*, 32*b*, 33*a*, 33*b* during the sheet feeding operation can be further minimized.

In the sheet feeder 10 of the first embodiment, the sheet separating unit 31 having a high coefficient of friction protrudes from the inclined separating surface 8, in the extension of the line of the sheet feeding action Q of the sheet feed roller 21, in order to abut against the leading edges of the middle areas of the sheets P to separate the sheets P one by one from the stack. In addition, because the inclined separating surface 8 has a curved surface such that the portion near the sheet separating unit 31 is uplifted and the surface is gradually lowered near its ends in the sheet width direction, the leading edges of the middle areas of the sheets P can be sufficiently subjected to the sheet separating action by contacting the sheet separating unit 31 while the leading edges of the side areas of the sheets P do not interfere with the inclined separating surface 8 or contact the inclined separating surface 8 but with little resistance to the leading edges of the side areas of the sheets P. Accordingly, the sheet feeding problem, such as the multi-feed problem, can be prevented.

FIG. 7 shows a structure of an inclined separating surface 8 according to a second embodiment of the invention. In the second embodiment, an urging member (not shown), such as a coil spring, is provided at the underside of each of the movable separating plates 32*a*, 32*b*, 33*a*, 33*b* to urge the movable separating plates 32*a*, 32*b*, 33*a*, 33*b* upward. Thus, the movable separating plates 32*a*, 32*b*, 33*a*, 33*b* can move up and down while their upper surfaces are maintained parallel to themselves. A sheet feeder of the second embodiment is the same in structure as the sheet feeder 10 of the first embodiment, other than the descending direction of the inclined separating surface 8. In the second embodiment, also, the inclined separating surface 8 includes, in the initial state, an upwardly curved surface which has an appropriate curvature for the sheet feeding operation. When sheets P, having the letter-size and the rigidity of plain sheets, are used, the sheets P can be fed without interfering with the upper surfaces of the movable separating plates 32*a*, 32*b*, 33*a*, 33*b* (the inclined separating surface 8). In addition, the movable separating plates 32*a*, 32*b*, 33*a*, 33*b* form an upwardly convex surface appropriate for the sheet feeding operation by descending by an appropriate amount, in accordance with the rigidity and size of the sheets P stacked on the sheet holder 12, by which the leading edges of the sheets P stacked on the sheet holder 12 press the movable separating plates 32*a*, 32*b*, 33*a*, 33*b* when the sheet feed roller 21 drives to feed the sheets P. Accordingly, the second embodiment can provide the same effects as that obtained by the first embodiment.

The sheet separating unit 31 (the separating strip 34) is not limited to that shown in the above-described embodiments. A sheet separating unit in a different structure can be used as long as the sheet separating unit causes friction. Further, in the above-described embodiments, the invention has been applied to the sheet feeder 10 that includes the inclined sheet holder 12 with the fixed separating plate 15, the first movable separating plates 32*a*, 32*b*, and the second movable separating plates 33*a*, 33*b* inclinatorily provided at the lower portion of the sheet holder 12. However, the invention can be applied to a sheet feeder wherein the sheet holder 12 is provided substantially in the horizontal position, the fixed separating plate 15 and the movable separating plates 32*a*, 32*b*, 33*a*, 33*b* are disposed such that the sheet advance direction of the sheet P stacked on the sheet holder 12 extends toward the upwardly slanting direction, and the auxiliary support plate 19 is upwardly urged, between the sheet holder 12 and the fixed separating plate 15, by the leaf spring 19. It is needless to say that, in the invention, the upper surfaces of the separating plates 15, 32*a*, 32*b*, 33*a*, 33*b* (the inclined separating surface 8) can be formed in the same plate.

In the above-described embodiments, the description has been made by applying the invention to the multifunctional image forming apparatus 1. However, if an image forming apparatus includes the sheet feeder 10 of either of the above-described embodiments, the invention can be applied thereto. For example, the invention can be applied to a printer that does not have a facsimile function if the printer includes the sheet feeder 10 of either of the embodiments. According to the image forming apparatus including the sheet feeder 10 of either of the first or second embodiment, the multi-feed problem can be surely prevented. Therefore, predetermined images can be surely formed on sheets P, which are supplied one by one, by the image forming unit.

In the above-described embodiments, the sheets P are guided by the pair of the guide members 13*a*, 13*b* to contact the middle points of the leading edges of the sheets P with the sheet separating unit 31 (the separating strip 34), regardless of the size (width) of the sheets P. However, it is unnecessary to place the sheets P at the middle of the sheet holder 12. If the leading edges of the sheets P near the middle points of the sheets P contact the sheet separating unit 31 (the separating strip 34) (the sheets P are deviated to some extent in the right and left direction), substantially the same effects are created.

A problem does not occur even when the sheet separating unit 31 (the separating strip 34) is shifted to some extent from the extension of the line of sheet feeding action Q as long as the sheet separating unit 31 (the separating strip 34) is provided near the extension.

The values of the contact angles $\alpha$, $\beta$ are not limited to the values described in the above-described embodiments, but can be changed. Optimum values of the contact angles $\alpha$, $\beta$ are changed in accordance with the type of sheets to be fed, the shape and frictional coefficient of the separating strip 34, and an included angle between the sheet holder 12 and the inclined separating surface 8. However, when the sheet holder 12 is designed so as to be capable of feeding plain sheets, cardboard, postcards, envelops, and overhead transparency films, it is preferable that a difference of approximately between 1 and 8 degrees be provided between the contact angles $\alpha$ and $\beta$. Further, when the included angle between the sheet holder 12 and the inclined separating surface 8 is set to between 100 and 120 degrees, it is preferable that the difference of the contact angles $\alpha$ and $\beta$ be set to between 2 and 4 degrees.

While the invention has been described in detail with reference to the specific embodiments thereof, it would be apparent to those skilled in the art that various changes, arrangements and modifications may be applied therein without departing from the spirit and scope of the invention.

What is claimed is:

1. A sheet feeder that separates and feeds sheets, comprising:

a sheet holder that holds a plurality of sheets;

a sheet feed roller that holds the sheets in cooperation with the sheet holder and feeds a topmost sheet from the sheets stacked in the sheet holder; and an inclined separating surface that holds leading edges of the sheets in a sheet feed direction, wherein the sheet holder includes a fixed support plate, which is fixedly provided and has a fixed surface, and a movable support plate, which has a first movable surface and is disposed at a portion opposite to and near the sheet feed roller so as to be capable of retracting with respect to the fixed surface when the sheet feed roller feeds the sheets, the movable support plate includes an urging member that urges the first movable surface by a predetermined force, in a direction toward the sheets held by the sheet holder, wherein the first movable surface is pressed by the sheet feed roller and thus retracts with respect to the fixed surface when the sheet feed roller feeds the topmost sheet, and an arm can rotate about a center of rotation provided upstream of the sheet feed roller in a sheet feed force acting direction and has the sheet feed roller rotatably attached thereto.

2. The sheet feeder according to claim 1, wherein the sheet holder includes the fixed support plate, which is provided upstream in a sheet feed force acting direction of the sheet feed roller, and the movable support plate, which is disposed downstream in the sheet feed force action direction of the sheet feed roller and extends to the inclined separating surface continuously from the fixed support plate.

3. The sheet feeder according to claim 1, wherein the movable support plate has a rotation shaft extending in a sheet width direction, and retracts by rotating about the rotation shaft by the rotation force from the sheet feed roller.

4. The sheet feeder according to claim 3, wherein the movable support plate is rotatably attached to a lower end of the fixed support plate, and supportingly urged by a leaf spring member provided to an underside of the sheet holder.

5. The sheet feeder according to claim 1, wherein the inclined separating surface is provided with a separating unit, which is disposed at a first portion corresponding to a second portion where the sheet feed roller is provided, in the sheet width direction, and has a high coefficient of friction to contact the leading edges of the sheets to be fed by the sheet feed roller to separate the sheets.

6. The sheet feeder according to claim 5, wherein the separating unit protrudes and retracts with respect to the inclined separating surface.

7. The sheet feeder according to claim 1, wherein the movable support plate retracts so as to relieve deformation of the sheets caused in a sheet stacking direction at the time the sheets contact the inclined separating surface when the sheet feed roller feeds the sheets.

8. The sheet feeder according to claim 1, wherein the movable support plate is designed such that a difference of approximately between 1 and 8 degrees is provided between a first contact angle between the leading edge of the sheet to be fed and the inclined separating surface in an first state where the movable support plate is at an initial position without retraction from the fixed surface and a second contact angle between the leading edge of the sheet to be fed and the inclined separating surface in a second state where the movable support plate retracts.

9. The sheet feeder according to claim 8, wherein the movable support plate is designed such that, when the first contact angle between the leading edge of the sheet to be fed and the inclined separating surface is set to between 100 and 120 degrees in the first state where the movable support plate is at the initial position, the first contact angle and the second contact angle between the leading edge of the sheet to be fed and the inclined separating surface in the second state where the movable support plate retracts is provided with a difference of between 2 and 4 degrees.

10. The sheet feeder according to claim 1, wherein the movable surface of the movable support plate is restricted so as not to protrude above the fixed surface of the fixed support plate when the sheet feed roller is not driven.

11. The sheet feeder according to claim 1, wherein the movable support plate has a width, in the sheet width direction, substantially the same as a width of the sheet feed roller.

12. The sheet feeder according to claim 1, wherein the inclined separating surface includes a fixed member that has a fixed surface and a separating unit, and is fixedly provided to a first portion which corresponds to a second portion of the sheets where the sheet feed roller is provided and includes a movable member that is provided adjacent to the fixed member and has a second movable surface that can descend in the sheet feed direction when contacted with the sheets held by the sheet holder, while the sheet feed roller feeds the sheets.

13. The sheet feeder according to claim 12, wherein the movable member includes an urging member that urges the second movable surface by a predetermined urging force in a direction reverse to the sheet feed direction, and the second movable surface is pressed by the leading edges of the sheets subjected to the sheet feeding force from the sheet feed roller and descends when the sheet feed roller feeds the sheets.

14. The sheet feeder according to claim 13, wherein the sheet feed roller is provided substantially at a middle position in the sheet width direction, the fixed member is provided substantially at a middle position of the leading edges of the sheets in the sheet width direction, and the movable member includes second movable surfaces, which can independently descend, on both sides of the fixed member.

15. The sheet feeder according to claim 14, wherein the movable member includes a plurality of movable plates that form the second movable surfaces, wherein the movable plates are provided on each side of the fixed member and each of the movable plates can individually descend.

16. The sheet feeder according to claim 15, wherein, when the sheet feed roller feeds the sheets, the inclined surface forms a surface such that a portion near the separating unit is uplifted and the surface is gradually lowered toward at least one end of the inclined surface, in the sheet width direction, when viewed from a direction perpendicular to the sheet feed direction.

17. An image forming apparatus, comprising:

a sheet holder that holds a plurality of sheets;

a sheet feed roller that holds the sheets in cooperation with the sheet holder and feeds a topmost sheet from the sheets stacked in the sheet holder;

an image forming unit that forms images onto the sheets fed from the sheet holder; and an inclined separating surface that holds leading edges of the sheets in a sheet feed direction, wherein the sheet holder includes a fixed support plate, which is fixedly provided and has a fixed surface, and a movable support plate, which has a movable surface and is disposed at a portion opposite to and near the sheet feed roller so as to be capable of retracting with respect to the fixed surface when the sheet feed roller feeds the sheets, the movable support plate includes an urging member that urges the movable surface by a predetermined force, in a direction toward the sheets held by the sheet holder, wherein the movable surface is pressed by the sheet feed roller and thus retracts with respect to the fixed surface when the sheet feed roller feeds the topmost sheet, and an arm can rotate about a center of rotation provided upstream of the sheet feed roller in the sheet feed force acting direction and has the sheet feed roller rotatably attached thereto.

18. A method of feeding sheets with a sheet holder that holds a plurality of sheets, a sheet feed roller that holds the sheets in cooperation with the sheet holder and an inclined separating surface that holds leading edges of the sheets in a sheet feed direction, comprising:

feeding a topmost sheet from the sheets stacked in the sheet holder;

maintaining a position of a first surface of the sheet holder when the topmost sheet is fed; and retracting the position of a second surface of the sheet holder, which is disposed at a portion opposite to and near the sheet feed roller, with respect to the first surface when the sheet feed roller feeds the topmost sheet, wherein:

the second surface is urged by a predetermined force, in a direction toward the sheets held by the sheet holder, wherein the second surface is pressed by the sheet feed roller and thus retracts with respect to the first surface when the sheet feed roller feeds the topmost sheet, and an arm is rotated about a center of rotation provided upstream of the sheet feed roller in a sheet feed force acting direction with the sheet feed roller rotatably attached to an arm.

* * * * *